United States Patent [19]

Bellatty et al.

[11] 4,364,034

[45] Dec. 14, 1982

[54] MONITORING SYSTEM FOR MOVEMENT OF TUNNELS AND OTHER STRUCTURES

[76] Inventors: Thomas A. Bellatty, 139 Smull Ave., West Caldwell, N.J. 07006; Joseph S. Zadik, 944 52nd St., Brooklyn, N.Y. 11219; Richard Mast, 97 Steele Ave., Staten Island, N.Y. 10306

[21] Appl. No.: 218,458

[22] Filed: Dec. 19, 1980

[51] Int. Cl.[3] ..... G08B 21/00

[52] U.S. Cl. ..... 340/690; 33/111

[58] Field of Search ..... 340/690, 686; 299/1; 405/132; 33/1 H, 1 D, 1 M, 125 B, 303, 312, 346; 116/329, DIG. 2; 200/61.13

[56] References Cited

U.S. PATENT DOCUMENTS

| | | | |
|---|---|---|---|
| 487,427 | 12/1892 | Poole . | |
| 1,166,019 | 12/1915 | Taylor et al. . | |
| 1,541,616 | 6/1925 | Boggs . | |
| 2,636,274 | 4/1953 | Marsh . | |
| 3,276,123 | 10/1966 | Huggenberger . | |
| 3,323,216 | 6/1967 | Üblacker . | |
| 3,427,724 | 2/1969 | Tracy . | |
| 3,451,136 | 6/1969 | Shuttle, Jr. . | |
| 3,484,136 | 12/1969 | Colson . | |
| 3,831,287 | 8/1974 | Sawdo et al. . | |
| 3,962,693 | 6/1976 | Schamblin . | |
| 4,070,906 | 1/1978 | Rupert et al. | 33/125 B |

*Primary Examiner*—Glen R. Swann, III
*Attorney, Agent, or Firm*—Lee C. Robinson, Jr.

[57] ABSTRACT

A thin wire with known properties of thermal expansion is suspended under constant tension between two fixed points and passes through an aperture in a measuring plate mounted on a wall or ceiling. The plate is mounted to permit relative movement of the plate with respect to the wire so that the plate aperture can be initially centered with respect to the wire. A pair of cursors are movably mounted on the plate relative to the aperture and have intersecting or overlapping cursor elements which cooperate with linear measurement scales on the plate to enable the operator to establish coordinates for the cursor element intersection point as an aid in placing the plate aperture at a location where the wire is at the center of the aperture. At periodic intervals the cursors are realigned with the wire to determine the wire's coordinates and whether the plate aperture has moved from its initial location relative to the stationary wire. An automatic electric alarm may be provided which includes a plurality of electrically conductive metal foil elements positioned about the periphery of the aperture and which signals upon movement of the wire beyond a predetermined distance within the aperture.

33 Claims, 9 Drawing Figures

FIG. 3
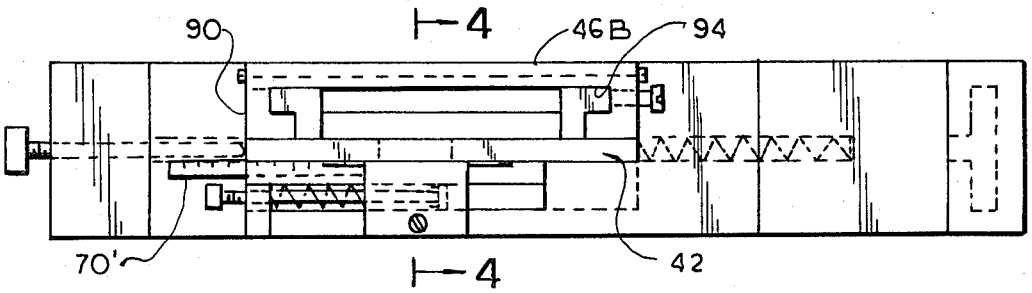
FIG. 4
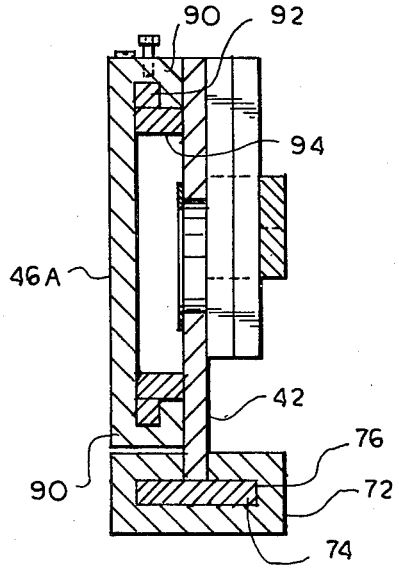
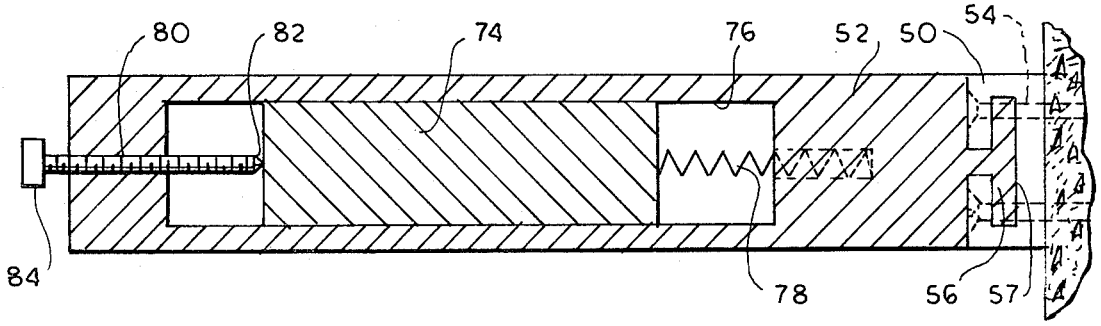
FIG. 5

MONITORING SYSTEM FOR MOVEMENT OF TUNNELS AND OTHER STRUCTURES

BACKGROUND OF THE INVENTION

The present invention relates to a system for monitoring movement in three mutually perpendicular directions in structures, and more particularly to a system for detecting movement in underground tunnels.

Underground tunnels such as are used for automobile and rail river crossings are generally quite long, and subject to substantial overburden loads. Typically the tunnels are designed to permit some degree of movement of the tunnel to accomodate variations in the overburden and other loads on the tunnel. The amount of tunnel movement normally permitted will be several inches over a substantial length of the tunnel, without causing any structural damage to the tunnel. However, tunnel movements must be monitored, or at least checked periodically, to determine whether excessive movements have occurred, or whether the rate of movement is increasing. These data on tunnel movements provide a basis for deciding whether remedial action is required. If construction near the tunnel is contemplated, or in progress, continual monitoring of tunnel movement is obviously preferred, as it can provide an early warning indication of a deteriorating situation, such as might occur where a landfill is built above or adjacent to a submerged tunnel at a river crossing or, when nearby construction might cause tunnel movement or deformation.

SUMMARY OF THE INVENTION

It is an object of the present invention to provide a system for monitoring tunnel or other structure movements.

Another object of the present invention is to provide a tunnel or other structure movement monitoring system which is relatively simple in construction.

Another object of the present invention is to provide a tunnel movement monitoring system which is accurate and reliable in operation.

Another object of the present invention is to provide a tunnel or other structure movement monitoring system which is fast in operation.

A still further object of the present invention is to provide a tunnel movement monitoring system which will provide an automatic alarm signal upon a tunnel movement in excess of a predetermined amount.

Yet another object of the present invention is to provide a tunnel movement monitoring system which will enable measurements of tunnel movement to be taken in three mutually perpendicular directions.

In accordance with an aspect of the present invention a tunnel monitoring system is provided which utilizes a thin, elongated wire with accurately known thermal expansion characteristics suspended in a tunnel along a substantial length thereof, for example, one thousand feet or greater, as the basis from which measurements are taken to determine movement of the tunnel between the support points of the wire. Pulleys, or rollers and the like support the wire under a constant tension. The wire passes through the circular aperture of a measuring plate which is mounted on the tunnel wall by a mounting arrangement that permits an initial adjustment of the plate relative to the wire, in a plane perpendicular to the wire, so that at the beginning of the monitoring operation the wire is located at the center of the plate aperture. The plate is then securely fastened to the tunnel so that any future movement of the plate with respect to the wire will indicate a movement of the tunnel itself.

To aid in locating the wire at the center of the aperture, and to measure deviations of the plate from that wire, a pair of cursor elements are movably mounted on the plate in perpendicular relation to each other. These cursor elements include cursor wires or the like which overlie and extend across the aperture so that, when viewed in plan or section, the cursors intersect to form a mobile cursor point. A pair of linear measurement scales are mounted on the plate parallel to the paths of travel of the cursors, and beneath the cursor wires, to provide numerical coordinates for the location of the mobile cursor point. Thus, by establishing the cursor point at the center of the aperture plate, with the aid of these linear measurement scales, the plate can be moved so that the cursor point engages the wire, thereby to locate the center of the plate aperture at the wire. After the wire is located in this manner and the plate is fixed to the tunnel or structure, the cursors are moved away from the aperture. Thereafter, the location of the plate is periodically checked by moving the cursors into contact with the wire and reading the coordinates of the cursor point from the linear scales. These coordinates, when compared with the coordinates obtained when the plate was first located with respect to the wire, will provide an indication of the amount and direction of relative movement between the non-moving wire and the plate aperture fixed to the tunnel. In this way tunnel maintenance personnel can determine whether tunnel movement has occurred.

Changes in the distance between selected points along a tunnel or other structure can be determined by comparing locations of points on the tunnel or structure with marked points on the wire. Changes in the distance between wall points can be determined by the length of the wire because the thermal expansion characteristics of the wire are known very accurately. Changes in the length of the tunnel or other structure can be determined by comparing relative movements between the wire and the wall plates.

In one preferred embodiment of the invention, an automatic alarm is set off if the movement in a tunnel or other structure causes the plates and cursors to exceed predetermined limits and contact the wire. In this embodiment electrically conductive metallic elements are placed about the periphery of the aperture so that in the event of a tunnel movement that is greater than a predetermined limit, causing the periphery of the aperture and the conductive elements to contact the wire, an alarm will sound immediately notifying tunnel personnel of the undesirable tunnel movement at the location of that plate.

The above, and other objects, features, and advantages of this invention will be apparent in the following detailed description of an illustrative embodiment thereof, which is to read in connection with the accompanying drawings, wherein:

BRIEF DESCRIPTION OF THE DRAWINGS

FIG. 3 is a plan view of the device shown in FIG. 2;

FIG. 4 is a sectional view taken along lines 4—4 of FIGS. 2 and 3;

FIG. 5 is a sectional view taken along line 5—5 of FIG. 2;

DESCRIPTION OF THE PREFERRED EMBODIMENT

Figure 1:
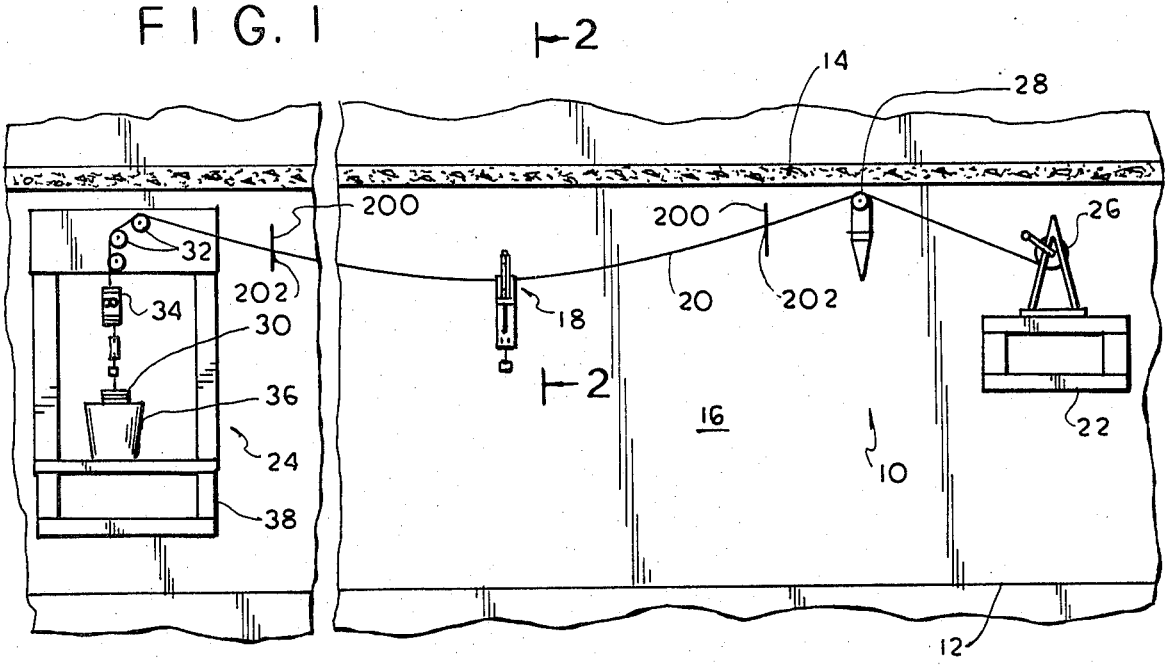
FIG. 1 is a plan view of a wire system for monitoring tunnel movements constructed in accordance with the present invention.

Referring now to the drawings in detail, and initially to FIG. 1 thereof, a wire system 10 for monitoring tunnel movements is shown mounted within a tunnel 12 beneath the road bed 14 of the tunnel. In tunnel construction the tunnel is typically formed by the installation of large, elongated castiron or steel rings in which an internal road bed is later formed. The road bed extends across a horizontal chord of the tube, leaving an access chamber 16 located below the road bed within the tube. This chamber provides fresh air within the tunnel. In accordance with the present invention, the monitoring system is mounted within this chamber along the side wall of the tunnel.

The monitoring system includes one or more monitoring stations 18 and a thin, elongated tensioned wire 20 suspended within the tunnel. The wire illustratively is a 0.01 inch diameter steel wire mounted along a major portion of the tunnel and, for example, may have a length of one thousand feet or more, with its opposite ends respectively secured to an anchor station 22 and a tensioning station 24. At the anchor station, one end of the wire is attached to a lockable winch 26 of conventional construction, that enables the end of the wire to be held fast at constant tension at this location. From the winch the wire is guided over a plurality of pulleys 28 located as required along the tunnel to maintain the wire suspended above the base of the tunnel wall. This arrangement permits the wire to follow the horizontal curvature of the tunnel as well as to follow the variation in grade in the tunnel. The wire 20 passes through the monitoring station 18 and at its opposite end is connected to a weight 30 of predetermined mass at the tensioning station 24.

The tensioning station 24 includes a plurality of pulleys 32 which guide the end of the wire into a vertical position for attachment to the weight 30. The extreme end of the wire is secured to a clamp 34, more fully described hereinafter, from which weight 30 is suspended. To dampen movements of the weight as a result of air disturbance and movements in the tunnel, the weight is suspended, in a receptacle 36 which may be filled with a viscous material such as oil. The container is supported within the tunnel in any convenient manner such as, for example, a wooden framework 38 secured to the walls of the tunnel in a rigid manner.

Figure 2A:
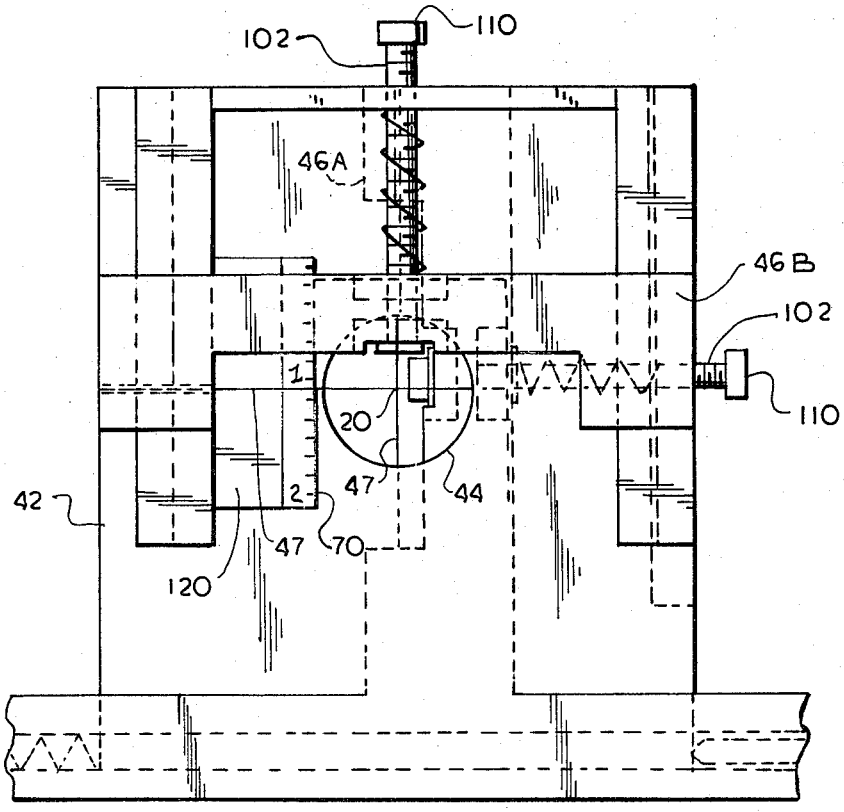
FIG. 2A is an elevational view from the opposite side of the mounting plate used in the device of FIG. 2.
Figure 2:
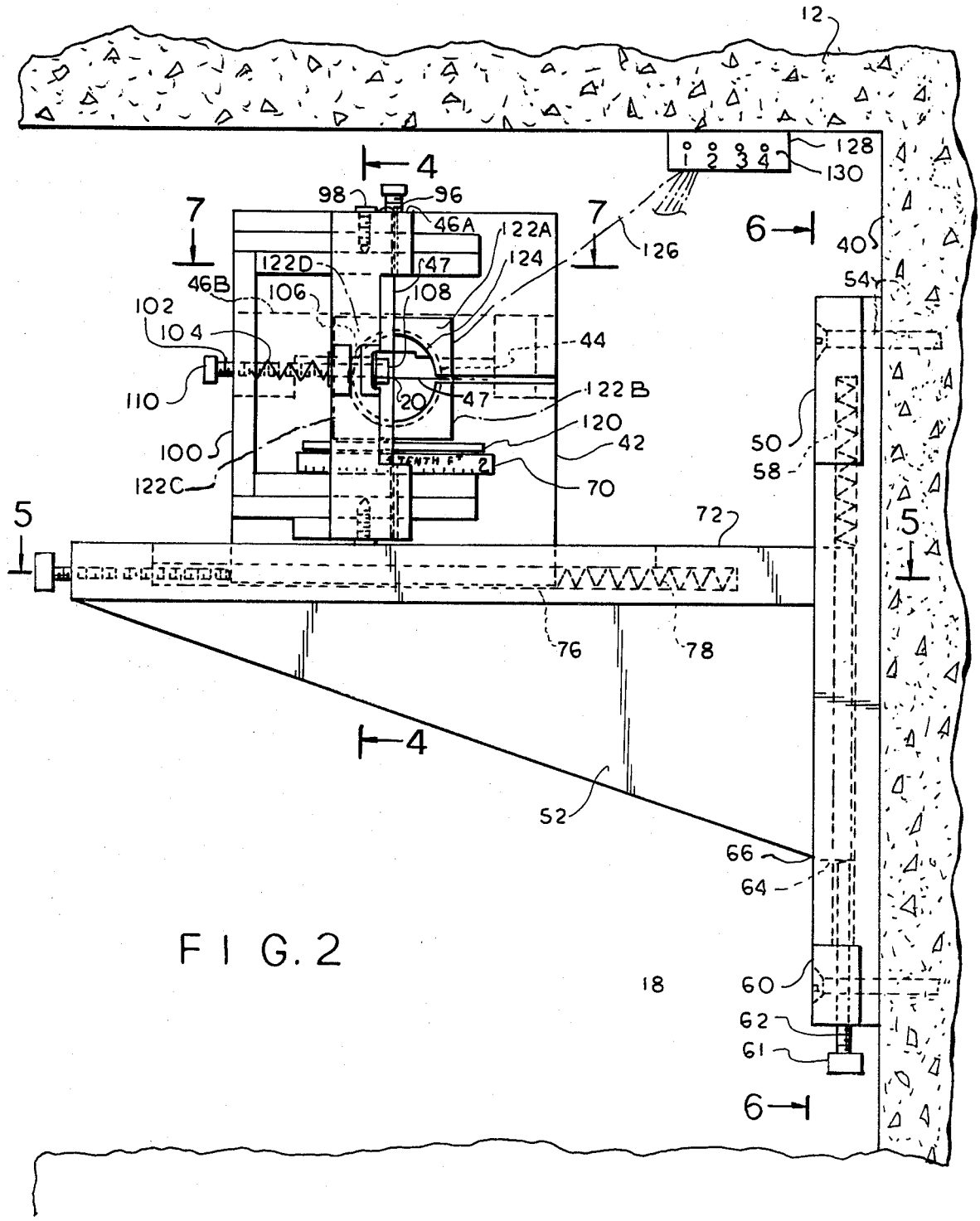
FIG. 2 is an enlarged side view taken along line 2—2 of FIG. 1 showing the device used to monitor tunnel movement in the system of FIG. 1.

Monitoring station 18 is illustrated in greater detail in FIGS. 2 and 2A. The purpose of the monitoring station is to determine relative movement between the tunnel wall and the wire at the monitoring station. Such movement can occur, for example, because of an increase or decrease in the overall burden on the tunnel as a result of excavations or landfills in the water above the tunnel. This load on the tunnel may cause horizontal and vertical movement of the tunnel walls at any monitoring station, thus producing relative movement between a monitoring station located between the fixed ends of the wire and the wire itself. While, as mentioned, some degree of movement in the tunnel is permitted to accomodate natural forces and thermal expansions and contractions as well as varying traffic loads in the tunnel, excessive tunnel movements could result in catastrophic failures. Thus, by monitoring the movements in the tunnel, a deteriorating situation can be anticipated and avoided.

Monitoring station 18 is rigidly mounted on tunnel wall 40 and includes a monitoring plate 42 which is movably mounted in the monitoring station so that its initial position can be adjusted with respect to wire 20. The monitoring plate has a central circular aperture 44 formed in it through which the wire at constant tension 20 passes. A pair of cursor members 46A and 46B are movably mounted on opposite sides of mounting plate 42, as seen in FIGS. 2 and 2A respectively, for movement in perpendicularly related paths of travel. Each cursor has a cursor wire or element 47 mounted therein which extends across aperture 44. The cursors can be positioned so that their wires overlie or intersect one another at the center of aperture 44 to provide a reference point when setting up the monitoring station. With the cursors centered in this manner, the position of plate 42 can be adjusted so that wire 20 is located at the center of aperture 44. Thereafter, the cursors are moved away from the aperture, until a measurement is taken. After the plate has been fixed to the tunnel wall, any relative movement between the wire and the monitoring station, will cause the relative position of the wire in aperture 44 to change, and the amount of that change can be determined by use of the cursors, as described hereinafter. This measurement will provide the tunnel personnel with an indication of amount of tunnel movement.

Monitoring station 18 includes a wall mounting bracket 50 in which a mounting arm 52 is supported. Wall bracket 50 is securely mounted in a fixed position on wall 40 by a plurality of bolts 54 or the like. Arm 52 on the other hand is slidably mounted in bracket 50 for controlled vertical movement with respect thereto.

As seen more clearly in FIG. 5, arm 52 has a T-shaped tongue 56 formed at its rear end, which is received within a complementary slot 57 formed in wall bracket 50. A spring 58 is captured within wall bracket slot 57 and normally biases the arm downwardly. The lower end of slot 57 in wall bracket 50 is closed by a stop 60 in which an elongated threaded screw 62 is mounted. The upper end of 64 of screw 62 engages the lower surface 66 of arm 52 so that by turning the knurled end 61 of screw 62 the vertical position of arm 52 can be adjusted relative to the wall bracket. This movement of arm 52, which carries plate 42 with it, will vary the vertical position of plate 42 with respect to wire 20.

Figure 6:
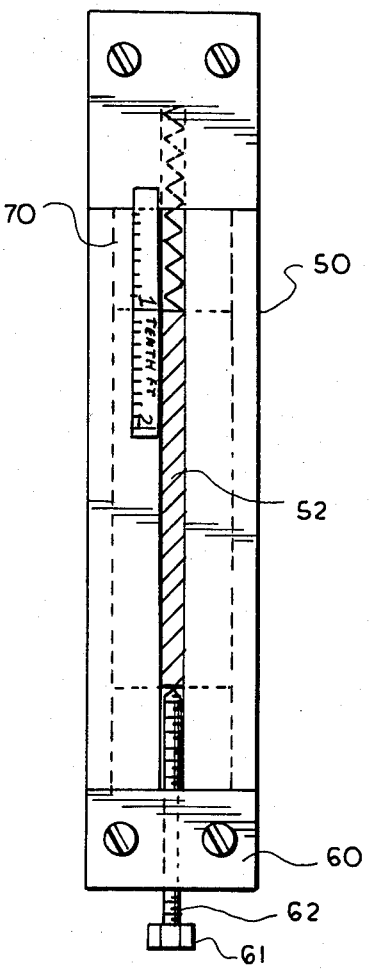
FIG. 6 is a sectional view taken along line 6—6 of FIG. 2.

In order to provide a reference coordinate for the vertical position of arm 52 a linear measure scale 70 (see FIG. 6) is secured to the face of wall bracket 50 adjacent the path of travel of arm 52 so that the gradations on the scale align with the upper surface 72 of the arm. Thus, at any position of arm 52 relative to bracket 50 the operator can note the coordinate provided by scale 70 in order to maintain a record of the established reference points in the monitoring system at the beginning of the monitoring operation.

Plate 42 is mounted on arm 52 by a similar arrangement to provide for horizontal adjustment of the plate relative to wire 20. As seen in FIGS. 4 and 5, the plate 42 has a perpendicularly extending base element or flange 74 secured thereto, in any convenient manner, and received in a slot 76 formed in the upper surface 72 of arm 52. Base 74 slides in slot 76 and is biased to the left in FIGS. 2 and 5 by a coiled spring 78. Movement of plate 42 under the influence of spring 78 is resisted by a screw 80 whose end 82 engages the left face of plate 74. Rotation of the knurled end 84 of screw 80, which is threadedly engaged in the end of arm 52, will cause movement of the plate 42 in the horizontal direction.

As seen in FIG. 3, a linear measure scale 70' is provided on the top surface 72 of arm 52, adjacent the path of travel of plate 42, so that its gradations align with the left edge of the plate 42 to provide a coordinate system locating plate 42.

Cursors 46*a*, 46*b* are generally flat, elongated members, having U-shaped flanges 90 formed at their ends (see FIGS. 3 and 4). These flanges receive the legs 92 of angle members 94 mounted on plate 42 in any convenient manner. For example, the mounting plate and angles may be made of metal and welded together, or they may be made of a clear plastic or plexiglass material and glued together, in any convenient manner. As seen in FIGS. 2, 3 and 4, angles 94 are positioned at right angles to each other on opposite sides of plate 42 to define perpendicularly related slide paths for their respective cursors.

As previously mentioned, each cursor has a thin wire 47 secured thereto in position, as seen in FIGS. 2 and 2A, to extend across aperture 44 in plate 42. This wire is secured to the projecting legs of the cursor in any convenient manner. In the illustrative embodiment of the invention (FIG. 2) wires 47 extend through bores 96 in the legs of the cursors and are wrapped around screws 98 threaded into the ends of the cursor. Other mounting arrangements for the wire can be provided, however, the illustrative embodiment enables the cursor wires to be maintained in a taut condition.

While the cursors may be simply slidably mounted on the angles 94 and held in any predetermined position by a set screw or the like threaded through channel 90 and engaged against angle 94, in the illustrative embodiment, a micrometer adjustment is provided for the cursor. This micrometer adjustment is shown in FIGS. 2 and 3, wherein it is seen that a vertical plate 100 is secured to plate 42, parallel to the cursor 46*a*. A screw 102 is threaded securedly in plate 100 and a spring 104 surrounds the screw between the plate and cursor 46*a*. The free end of screw 102 extends through an threaded opening 106 in the cursor and is engaged by a nut 108. By this arrangement, rotation of screw 102, by turning of the knurled end 110 thereof, will cause the cursor to move to the right or left along the slides provided by angles 94. Thus, the position of wire 47 of the cursor relative to the aperture 44 can be accurately adjusted. A similar micrometer adjustment is provided for the cursor 46B, as shown in FIG. 2A.

When monitoring station 18 is initially established in position, cursors 46*a* and 46*b* are positioned by the adjustment of their micrometers so that the cross wires thereof intersect or overlap at the center of the circular aperture 44. To aid in locating this central point, the opposite faces of plate 42 are provided with linear measurement scales 70 arranged parallel to the paths of travel of their respective cursors. The graduations on these scales are arranged so that one of the graduations aligns with the diameters of the aperture 42, in order to locate the center of the circle. The remaining graduations will provide, as described hereinafter, identifying coordinates for the location of the wire after relative movement between the wire and the monitoring station.

In the illustrative embodiment, by aligning the cursor wires with the zero points on the scales, the wires align with the center of the circle. Once this point is established with the cursors the positions of the arm 52 and plate 42 are adjusted by use of micrometers 68 to align the central cursor point defined by wires 47 with wire 20. This establishes a reference point for the commencement of the monitoring operation from which deflection measurements will be taken. After the location of the plate 42 is established in this way, cursors 46*a* and 46*b* are moved away from aperture 44 so that the aperture is completely unobstructed by wires 47.

Periodically the relative position of plate 42 and wire 20 is checked, to determine whether there has been a movement in the tunnel. This movement might result from movement of the tunnel at the location of the monitoring station 18 or from movement at either or both of the supported ends of wire 20. Such movements will cause relative movement between the wire and the periphery of aperture 44. To determine the extent of this movement, the operating personnel move the cursors 46*a*, 46*b* into position adjacent wire 20 so that the intersecting point of wires 47 approximate the location of the wire 20. Since wires 47 on the cursors extend over linear scales 70, the coordinates provided by the graduations on the linear scales can be recorded and a determination can be made as to the position of wire 20 in aperture 44 relative to the initial central starting point. These coordinates can then be used to calculate the relative deflection which occurred in the tunnel.

To aid in accurate reading of the graduation on linear scales 70 with wires 47, mirrors 120 are adhered to plate 42 adjacent and parallel to linear scales 70. When reading the scales, the reader aligns his eye with wire 47 so that the reflection of the wire in the mirror is not seen and is obstructed by the wire itself. In that position the eye will then read the exact graduation on the scale, or any intermediate valve between graduations with no aberration occurring by inadvertently reading the scale at an angle.

In accordance with another feature of the present invention, the monitoring station can be provided with an automatic alarm system to provide a warning in the event that a major deflection occurs between monitoring operations. This alarm system includes a plurality of electrically conductive metal foil elements 122 positioned about the periphery of aperture 44. In the illustrative embodiments of the invention four independent foil elements 122*a–d* are provided, each of which extends through one quadrant about the periphery of the aperture 44. Each segment has an inner edge 124 which is arcuate in shape and extends inwardly of the periphery of aperture 44. The conductive segments 122*a*–122*d* are connected by wires 126 to an electrical alarm or buzzer system 128 of conventional construction. When wire 20 contacts one of the conductive sheets 122 the alarm will sound. In addition, the alarm may be provided with individual indicating lights 130, identified by reference numerals 1–4 in FIG. 2, separately controlled by the individual segments 122, so that the alarm provides a visual indication of the direction of the deflection which has occurred. The specific electrical circuitry utilized in the alarm system shown would be apparent to those skilled in the art and thus need not be described in detail.

In lieu of the quadrant elements 122, a unitary circular or elliptical conductive ring may be used.

Figure 8:
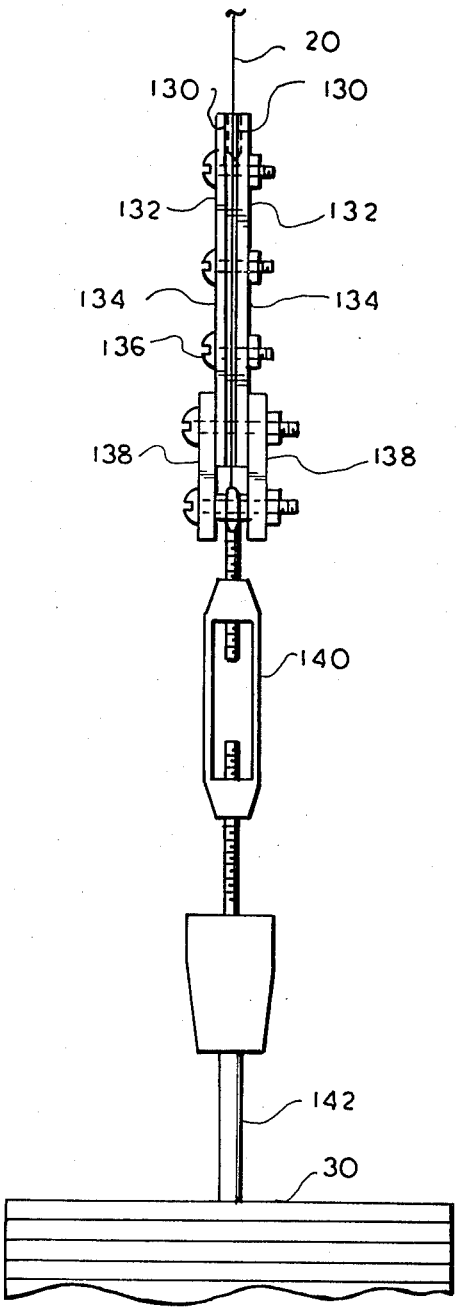
FIG. 8 is an enlarged view of the clamp used to tension the end of the cable, shown at the left in FIG. 1.
Figure 7:
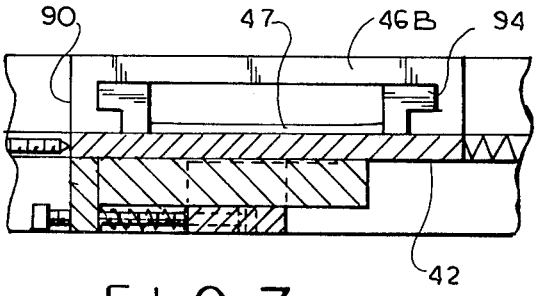
FIG. 7 is a sectional view taken along line 7—7 of FIG. 2.

Referring to FIG. 8 of the drawing, the clamping arrangement for tensioning wire 20 is illustrated. As seen therein, wire 20 is engaged between a pair of rough sheets of material 130, such as for example, emery cloth, which are in turn clamped between two rigid plates 134 by bolts 136. This clamp assembly is in turn connected by plates 138 to a turn buckle 140 from which weight 30 is suspended. Operation of the turn buckle will adjust the depth of immersion of the weight in the liquid filled container 36 (FIG. 1). The weight itself may consist simply of a series of heavy metal plates supported on a post 142 secured to turn buckle 140.

Using the wire 20 of the invention, the distance between selected points along a tunnel or other structure can also be determined and/or monitored. For example, once wire 20 is positioned, as shown in FIG. 1, calibration points 200 may be marked on the tunnel wall and on adjacent points 202 on wire 20. The change in distance between these wall points can be determined by the length of the wire because the thermal expansion characteristics of the wire are known very accurately. Changes in the length of the tunnel or other structure also can be determined by comparing relative movements between marked points on the wire and the scales on the wall or monitoring plates. The wire is marked in any convenient manner.

By the arrangement of the present invention, a relatively simple tunnel movement monitoring device is provided which will produce accurate measurements of any deflection or variation in the length of the tunnel as well as an early warning of excessive deflection. This arrangement is far simpler than conventional optical survey methods commonly used to monitor tunnel movements and is a much faster monitoring procedure to perform than those procedures which have been used in the past. The cursor system provides both horizontal and vertical deflections at the same time using an accurate micrometer system.

Although in the illustrative embodiment only a single cursor station has been shown, multiple cursor stations can be placed along the length of the wire 20 which, as described above, may be in the length of one thousand feet or more.

Although an illustrative embodiment of the invention has been described herein with reference to the accompanying drawings it is to be understood that the invention is not limited to that precise embodiment, and that various changes and modifications may be effected therein by one skilled in the art without departing from the scope or spirit of this invention.

What is claimed:

1. A wire system for monitoring movements of tunnels and other structures comprising a thin elongated wire with known properties of thermal expansion, means for supporting said wire between at least two fixed points in a tunnel, means for applying a constant tension to said wire to secure it in a stable configuration and means for monitoring movement of a measuring plate fixed to the tunnel at a monitoring point and having an aperture formed therein through which said wire extends and a pair of mutually perpendicular cursor means movably mounted on said plate relative to said wire for providing an indication of the position of said wire in said aperture.

2. The system as defined in claim 1 wherein each of said cursor means includes a thin wire, said cursor wires extending perpendicular to each other to define a mobile cursor point at their intersection which may be moved into juxtaposition with the elongated wire to locate the elongated wire in the aperture.

3. The system as defined in claim 2 including linear micrometer scale means on said plate adjacent each of said cursor means and positioned parallel to the respective cursor wires to provide a numerical indication of the location of the elongated wire in said aperture.

4. A system as defined in claim 3 including means for variably positioning said plate relative to the elongated wire and then fixing the plate to the tunnel wall.

5. A system as defined in claim 1 including means for signalling automatically an alarm upon movement of said plate fixed to the tunnel with respect to said wire beyond a predetermined distance.

6. The system as defined in claim 5 wherein said signalling means includes an electrically conductive element surrounding said aperture and extending inwardly thereof for producing an electrical signal upon contact with said wire.

7. The system as defined in claim 6 wherein said electrically conductive element comprises four separate quadrant-shaped elements surrounding said aperture.

8. The system as defined in claim 6 wherein said electrically conductive element comprises a ring surrounding said aperture and having a shape which is elliptical, said elliptical shape including a circular shape.

9. A system as defined in claim 1 wherein said wire has opposed end portions and said supporting means comprises a plurality of pulleys over which the wire is trained.

10. A system as defined in claim 9 wherein said constant tensioning means comprises a winch secured to one end of the wire and a weight secured to the other end.

11. A system as defined in claim 10 including means for damping movement of said weight comprising a supply of liquid in which said weight is suspended.

12. A wire system for monitoring movements in a structure, the wire system comprising a thin elongated wire, means for supporting said wire between at least two spaced points, a measuring plate having an aperture formed therein through which said wire extends, means for applying a constant tension to said wire, means for monitoring and measuring movement of said measuring plate with respect to said wire, means for mounting said plate on said structure including means for adjusting the position of said plate relative to the wire in a plane perpendicular to the wire, and a pair of mutually perpendicular cursors movably mounted on said plate relative to said wire, said cursors including means for determining the location of said wire within said aperture whereby said cursors may be moved to determine an initial location of the wire in the aperture, thereby establishing a point from which relative movement between the aperture and the wire may be measured, and thereafter to determine any change in the relative positions of the aperture and wire as a result of movement of the structure.

13. A wire system for monitoring movements in a structure comprising a thin elongated wire, means for supporting said wire between at least two fixed points, means for applying a constant tension to said wire and means for monitoring and measuring movement of said wire comprising a measuring plate having an aperture formed therein through which said wire extends, a pair of mutually perpendicular arranged cursors movably mounted on said plate and adapted to intersect at the center of said aperture, and means for moving said plate relative to said wire to locate said wire at the center of said aperture thereby to establish a reference point from which relative movement between the plate and the wire can be measured with the aid of said cursors.

14. A system as defined in claim 13 wherein said means for moving said plate comprises a mounting bracket adapted to be secured to said structure, a mounting arm extending perpendicularly from said bracket, means for adjusting the vertical position of the arm with respect to the bracket, and means for movably mounting said plate on the arm to vary the position thereof relative to the wire in a plane extending perpendicular to the wire passing through said aperture.

15. A system as defined in claim 14 wherein said arm is slidably mounted in said bracket and said means for adjusting the vertical position of the arm comprises a micrometer adjustment mounted in the bracket and engaged with said arm.

16. A system as defined in claim 15 including a linear scale secured to said bracket and extending parallel to the movement of the mounting arm to provide a reference measurement for the arm.

17. A system as defined in claim 15 wherein said means for movably mounting said plate includes a micrometer adjustment mounted in said arm and engaged with said plate.

18. A system as defined in claim 17 including a linear scale secured to said arm and extending parallel to the movement of said plate to provide a reference measurement for the arm.

19. A system as defined in claim 13 wherein said cursors each comprise a slide block slidably mounted on said plate and having a thin wire mounted thereon whereby the intersection of the cursor wires defines a mobile cursor point which when aligned with the elongated wire passing through the aperture establishes the location of the elongated wire in the aperture.

20. A system as defined in claim 19 including linear measure scales on said plate extending parallel to the paths of movement of the cursors in position to be crossed by the cursor wires, whereby the cursor wires and scales may be used to provide a numerical representation of the location of the mobile cursor point in the aperture.

21. A system as defined in claim 20 including a mirror mounted adjacent each of said linear scales.

22. A system as defined in claim 19 including micrometer adjustment means for moving said cursors relative to said aperture.

23. A system as defined in claim 13 including means for signalling an alarm upon movement of said wire beyond a predetermine distance within said aperture.

24. The system as defined in claim 23 wherein said signalling means includes an electrically conductive element.

25. The system as defined in claim 24 wherein said electrically conductive element comprises four separate quadrant-shaped elements surrounding said aperture.

26. The system as defined in claim 24 wherein said electrically conductive element comprises a ring surrounding said aperture and having a shape which is elliptical, said elliptical shape including a circular shape.

27. A system as defined in claim 13 wherein said wire has opposed end portions and said supporting means comprises a plurality of pulleys over which the wire is trained.

28. A system as defined in claim 27 wherein said tensioning means comprises a winch secured to one end of the wire and a weight secured to the other end.

29. A system as defined in claim 28 including means for damping movement of said weight comprises a supply of liquid in which said weight is suspended.

30. A system as defined in claim 13 wherein said means for applying constant tension to said wire comprises a weight and means for clamping said weight to one end of the wire including a clamp and a pair of sheets engaged in said clamp and having surfaces of a high friction coefficient engaging said wire to prevent slippage of the wire in said clamp.

31. A device for measuring relative movement of a wire passing therethrough including a measuring plate having a circular aperture formed therein through which said wire extends, means for mounting said plate on a fixed structure including means for adjusting the position of said plate relative to the wire in a plane perpendicular to the wire thereby to locate the wire at the beginning of the measuring operation at the center of said aperture; a pair of cursor means movably mounted on said plate in perpendicular relation to each other including cursor elements extending at least partly across the aperture to intersect and define a mobile cursor point; and linear scales on said plate having indicia thereon related to the coordinates of said aperture to permit the mobile cursor point to be located at the center of the aperture to guide adjustment of the plate in centering the aperture about the wire thereby establishing a fixed reference point and to measure deviation of the wire from said fixed reference point within the aperture.

32. A device for measuring movement of a wire passing therethrough including a measuring plate having a circular aperture formed therein through which said wire extends, means for mounting said plate on a fixed structure including means for adjusting the position of the plate relative to the wire in a plane perpendicular to the wire; a pair of cursor means slidably mounted on the plate for movement in perpendicularly related paths of travel each of which includes a cursor element extending across the aperture whereby the cursor elements overlie one another and, at their intersection, define a cursor point whose location may be varied upon movement of the cursors, and linear measurement scales having predetermined gradations thereon mounted on the plate parallel to the paths of travel of the cursors and below the cursor elements to provide numerical coordinates for the location of the cursor point within the aperture.

33. A device for measuring movement of a tunnel, the device comprising a monitoring plate fixed to a tunnel wall and a wire passing adjacent said plate under constant tension and having a known point marked on the wire whereby comparison of the relative positions of said point and said plate may be used to determine changes in the length of the tunnel.

* * * * *